US005188544A

United States Patent [19]

Mukai

[11] Patent Number: 5,188,544

[45] Date of Patent: Feb. 23, 1993

[54] ELECTRICAL CONDUCTOR TERMINAL APPARATUS AND METHOD

[76] Inventor: Tsuyoshi Mukai, 3-16-306 Tomobuchicho, 1-chome, Miyakojima-ku, Osaka-shi, Japan

[21] Appl. No.: 665,814

[22] Filed: Mar. 7, 1991

Related U.S. Application Data

[63] Continuation-in-part of Ser. No. 443,804, Nov. 29, 1989, abandoned, which is a continuation of Ser. No. 276,221, Nov. 23, 1988, abandoned.

[30] Foreign Application Priority Data

Nov. 30, 1987 [JP] Japan ..... 62-183568

[51] Int. Cl.[5] ..... H01R 11/01

[52] U.S. Cl. ..... 439/777; 439/287; 439/883; 439/907

[58] Field of Search ..... 439/287, 290, 777, 883, 439/889

[56] References Cited

U.S. PATENT DOCUMENTS

| | | | |
|---|---|---|---|
| 2,555,074 | 5/1951 | Bergan | 439/777 |
| 4,002,390 | 1/1977 | Perry et al. | 439/433 |
| 4,943,247 | 7/1990 | Wise | 439/883 |

FOREIGN PATENT DOCUMENTS

| | | | |
|---|---|---|---|
| 0074006 | 11/1944 | Switzerland | 439/883 |

*Primary Examiner*—Paula A. Bradley
*Attorney, Agent, or Firm*—J. Winslow Young

[57] ABSTRACT

A terminal for an electrical conductor, the terminal including a metal disc having a hole in its center along with a plurality of detents formed in the metal disc. The detents are configured to be received in nesting relationship with corresponding detents on adjacent terminals when the terminals are stacked with the holes in alignment. A bolt is passed through the holes to secure the terminals together. The nested detents restrict the terminals against rotational movement.

17 Claims, 4 Drawing Sheets

ELECTRICAL CONDUCTOR TERMINAL APPARATUS AND METHOD

RELATED APPLICATIONS

This application is a continuation-in-part application of my copending patent application Ser. No. 07/443,804 filed Nov. 29, 1989 for CONDUCTOR-CONNECTING TERMINAL IMPLEMENT in the name of Tsuyoshi Mukai (now abandoned) which is a continuation application of Ser. No. 07/276,221 filed Nov. 23, 1988 (now abandoned) for CONDUCTOR-CONNECTING TERMINAL IMPLEMENT in the name of Tsuyoshi Mukai (now abandoned).

BACKGROUND

Field of the Invention

This invention relates to terminals for electrical conductors and, more particularly, to a novel terminal apparatus and method for connecting a plurality of terminals firmly and without loosening over time.

Claim of Priority

Priority claim (35 USC 119) is made, based upon Japanese Application No. 183568 filed Nov. 30, 1987.

The Prior Art

Electrical energy is transmitted through conductors, each conductor terminating in an electrical connector commonly referred to as a terminal. Conventionally, the prior art terminal is configured as an enlarged, flattened metal plate against which a second, conductive metal plate is secured. The enlarged surface area of the metal plates assures an appropriate amount of surface area for adequate electrical contact between the metal plates. FIG. 1 is a representative example of a conventional set of electrical terminals shown generally at 10 and includes a pair of terminals 12, each of which are identical in construction. Terminal 12 is mounted to the end of an electrical conductor 16 which consists of a conductor for electrical energy shown herein as a plurality of wires 14. Electrical conductor 16 includes an insulative sheath 15 that encloses wires 14. Terminal 12 is configured as an enlarged, flattened disc 20 having a hole 21 located at the center thereof. A connector 22 extends from one edge of disc 20 and is configured to securely clamp wires 14 inside connector 22. This clamping action is achieved by connector 22 having two flanges **22*a* and 22*b* which are opened outwardly to receive wires 14 and then crimped inwardly against wires 14 to thereby securely mounting terminal 12 to the end of electrical conductor 16. Terminals 12 are secured together by passing a bolt 26 through holes 21 and mounting thereon a lock washer 27 and a nut 28**.

As shown, disc 20 is a flat element so that rotational forces applied to electrical conductors 16 in a direction about the axis of bolt 26 will tend to loosen the connection between each of disc 20. These rotational forces include vibration as well as other movements of electrical conductors 16. Ultimately, a separation occurs between the disc 20 and its matching disc 20 with the result that the desired degree of electrical contact is diminished resulting in arcing, metal oxide formation, and the like.

A number of prior art teachings have been directed to providing certain aspects of the need for adequate, secure electrical contact. Schumacher et al (U.S. Pat. No. 2,744,244) teaches an electrical connector for connecting two electrical conduits in an end-to-end configuration. The connectors include mating detents and indentations for interlocking the two connectors. Clasp portions on each connector resiliently grasp the opposite connector.

The patent of Sasaki et al (U.S. Pat. No. 4,832,629) teaches a crimp-style terminal fixed to an electrical connection such as a bar of an electrical source together with a plurality of other terminals stacked thereon. A bolt secures the stack together while the crimp-style terminal includes bent portions to restrict rotation of the other terminals relative to the crimp-style terminal.

Suzuki (U.S. Pat. No. 3,963,304) teaches a screw-type coupling for fixing an object in a desired position, the coupling including a threaded coupling of the discontinuous type formed a a double-surface toothed rack varying in height gradually in the direction of intended rotation.

The patent of Siemens (German Patent No. (DE 3,412,849) teaches an apparatus for releasably connecting aluminum electrical conductors. An intermediate washer-like device is fabricated from an appropriate metal other than aluminum and includes protrusions that are distributed asymmetrically with respect to a guide between the conductors. The protrusions are intended to penetrate the aluminum oxide layers on the conductors when the conductors are bolted together.

Czechoslovakian Patent No. 74006 teaches a similar, washer-like device for providing improved electrical connection. Alternating indentations and detents are formed in a circle about the center of the washer-like device.

Clearly, both this latter reference and the Siemens reference are directed to intermediate devices which are used to assure adequate electrical contact between two electrical conductors. As such, they are each somewhat analogous to the common prior art lock washer 27 shown in FIG. 1 in that they are simply intermediate devices having as their function the assurance of an appropriate electrical connection between two electrical connectors. Neither device is directed to inhibiting lateral movement of the electrical conductors because they are not part of the electrical conductors.

Japanese Utility Model Laid Open Publication No. 51-67932 (1976) discloses an implement in which protrusions are formed on one terminal plate while matching indentations are formed in the other terminal plate. The protrusions are received in the indentations to prevent the rotation of the clamping shaft. With the clamping shaft thus prevented from rotation, the risk of loosening the two conductors is reduced. However, this implement is not suitable for conductors connected at an angle other than the position shown.

In view of the foregoing, it would be an advancement in the art to provide terminals for electrical conductors whereby a plurality of terminals can be stacked with the electrical conductors oriented at various angles relative to each other. It would also be an advancement in the art to provide a terminal apparatus and method whereby a plurality of terminals can be stacked in nesting relationship and thereby secured against subsequent loosening under conditions of vibration or flexure of the various electrical conductors thus interconnected. Such a novel apparatus and method is disclosed and claimed herein.

BRIEF SUMMARY AND OBJECTS OF THE INVENTION

This invention relates to a novel terminal apparatus and method whereby the terminal plates are configured with matching indentations to accommodate a plurality of terminal plates being stacked with the indentations in nesting relationship. The nesting relationship of the indentations securely prevents the terminals from twisting orthogonally thereby significantly inhibiting the terminals from becoming loosened by the action of vibration or flexure of the electrical conductors to which the terminals are mounted. The indentations are configured to accommodate a plurality to terminals being connected at preselected angles and even in a back-to-back relationship.

It is, therefore, a primary object of this invention to provide improvements in terminals for electrical conductors.

Another object of this invention is to provide improvements in the method of connecting terminals for electrical conductors.

Another object of this invention is to provide a terminal for an electrical conductor wherein the terminal plates include mating indentations to accommodate the terminals being stacked in nesting relationship and with the electrical conductors oriented at preselected angles relative to each other.

These and other objects and features will become more readily apparent from the following description taken in conjunction with the accompanying drawing and the appended claims.

DETAILED DESCRIPTION OF THE PREFERRED EMBODIMENT

The invention is best understood by reference to the following description and the accompanying drawing wherein like parts are designated by like numerals throughout.

General Discussion

The novel terminal apparatus of this invention is designed to overcome the problem of terminals becoming loose over time. In particular, whenever it becomes necessary to join an electrical conductor with one or more electrical conductors, the connection takes place through the use of terminals, one of which is formed on the end of each of the electrical conductors. The terminal is configured as a circular disc having a hole in its center. A connector is formed on one edge of the circular disc and is configured to firmly engage the conductive wires at the end of the electrical conductor. Customarily, this connector is formed as an open sleeve which can be clamped against the conductive wires to provide not only a secure mechanical interlock with the conductive wires but also the necessary electrical connection between the conductive wires and the terminal.

Figure 1:
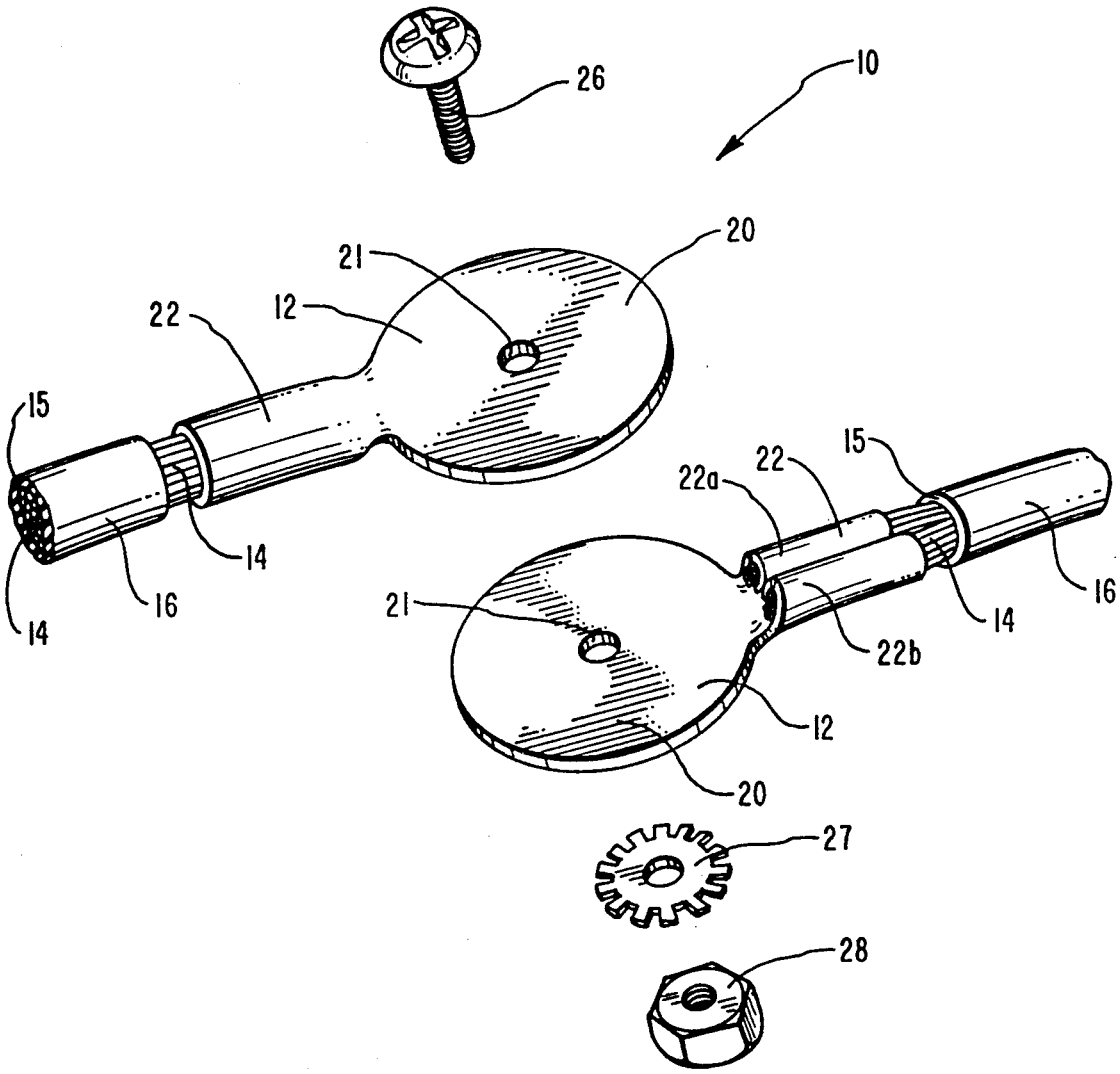
FIG. 1 (PRIOR ART)
FIG. 1 is an exploded perspective view of a pair of prior art terminals.

Historically, these conventional terminals were fabricated as shown in the Prior Art drawing of FIG. 1 wherein a pair of terminals 12 are shown generally at terminal connection 10. Each terminal 12 is clamped to the conductive wires 14 at the end of an electrical conductor 16. Conductive wires 14 are shielded by an insulative layer 15. Terminal 12 is configured with a flat disc 20 having a hole 21 at its center. A connector 22 is formed coextensively with disc 20 as an open sleeve 22 having a pair of flanges 22*a* and 22*b* which form the sides of open sleeve 22. Flanges 22*a* and 22*b* are crimped against conductive wires 14 so as to provide for the strong mechanical and electrical connection of terminal 12 to conductive wires 14 of electrical conductor 16. A bolt 26 is passed through hole 21 and secured with a nut 28. A lock washer 27 helps prevent nut 28 from becoming loosened.

The enlarged, flattened area of flat disc 20 provides for the appropriate amount of electrical conductivity between terminals 12. However, due to the flat surface, there is only a limited degree of frictional resistance to twisting of terminals 12 relative to each other in a direction that is rotational about the axis of holes 21. Further, even though there is adequate conductivity across terminals 12, the flow of electrical energy always generates a limited amount of heat energy. This warming of terminals 12 causes the metal therein to expand according to the coefficient of thermal expansion of the particular metal used to fabricate terminals 12. Repetitive expansion and contraction ultimately will cause nut 28 to work loose from bolt 26 even in the presence of lock washer 27. Flexure and vibration of electrical conductors 16 also imparts forces on terminal connection 10 causing the same to become loosened.

Detailed Description

Figure 2:
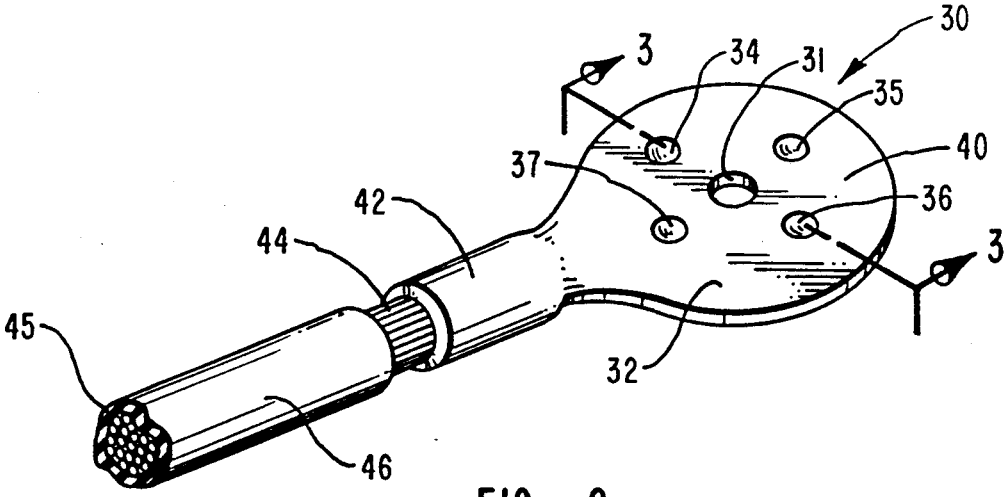
FIG. 2 is a perspective view of a first preferred embodiment of the novel terminal apparatus of this invention.
Figure 3:
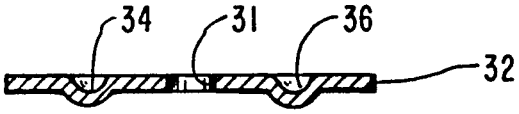
FIG. 3 is a cross sectional view taken along lines 3—3 of FIG. 2.

Referring now more particularly to FIGS. 2 and 3, a first preferred embodiment of the novel terminal apparatus of this invention is shown generally at 30 and includes a flat disc 32 having a connector 42 formed coextensively with flat disc 32. Connector 42 is configured to be securely clamped to conductive wires 44 of electrical conductor 46. Conductive wires 44 are electrically shielded by an insulative sheath 45. A hole 31 is formed in the center of flat disc 32. A plurality of detents 34–37 are formed in flat disc 32. Importantly, detents 34–37 are formed in a uniform spatial relationship and equidistantly from the center of hole 31. As illustrated, detents 34–37 are each formed at 90 degrees from the adjacent detent and along a circle approximately half the distance between the center of hole 31 and the edge of the circular portion of flat disc 32. With particular reference to FIG. 3, the formation of detents 34 and 36 is shown to more clearly illustrate their relationship to flat disc 32.

Figure 4:
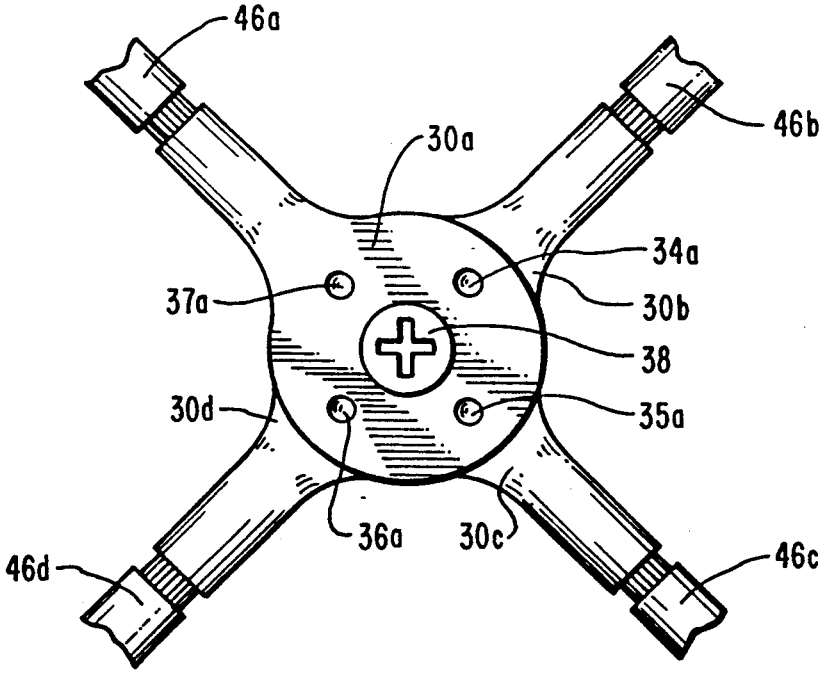
FIG. 4 is a plan view of four of the first preferred embodiment of novel terminal of this invention of FIG. 2 shown stacked with each terminal oriented at 90 degrees to the other terminals.

Referring now to FIG. 4, a plurality of terminals 30a–30d, are mounted in electrical contact to electrical conduits 46a–46d, respectively, and are shown in stacked relationship with each being oriented at a 90 degree position relative to the other. This positioning of terminals 30a–30d allows for the sequential nesting of detents 34a–37a of terminal 30a in the corresponding detents (not shown) of the next, underlying terminal 30b. Clearly, of course, the precise sequence of placement of terminals 30b–30d is immaterial since the respective detents are uniformly spaced from terminal 30a through terminal 30d. A bolt 38 passes through hole 31 (FIGS. 1 and 2) and is secured by a nut (not shown) so as to securely engage the entire stack of terminals 30a–30d together. Clearly, of course, any suitable number of terminals 30a–30d can be interconnected in this manner particularly since detents 34a–37a provide for an almost unlimited number to be stacked, one on top of the other. Regardless of the number of stacked terminals 30, detents 34–34 are designed to fit in nesting relationship between adjacent terminals 30 so as to releasably interlock terminals 30. This feature is important since it effectively inhibits rotational forces that would otherwise tend to loosen the nut (not shown) threadedly engaged to bolt 38.

Figure 5:
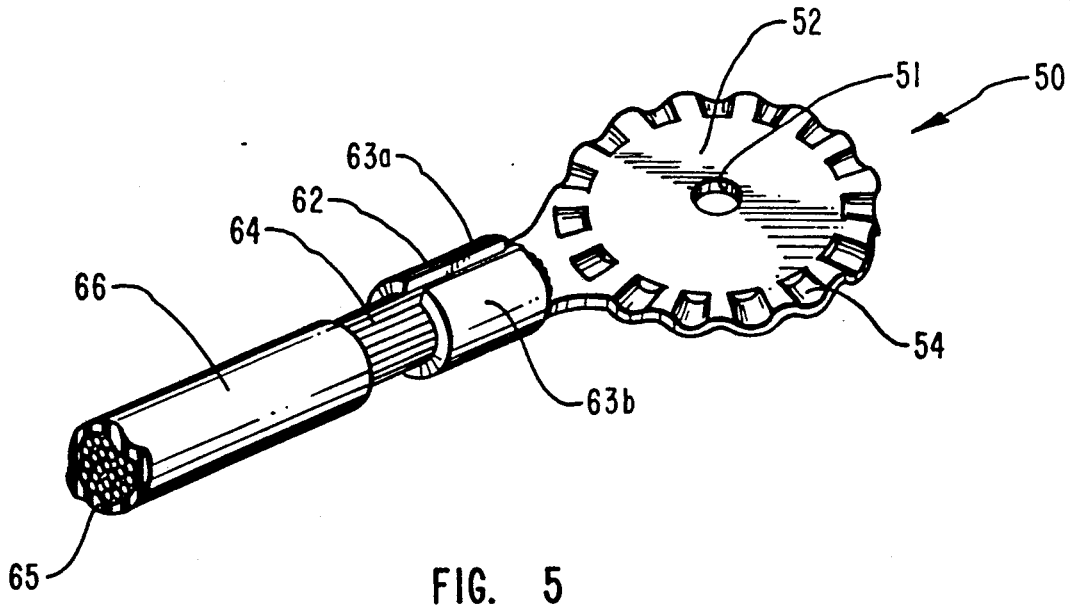
FIG. 5 is a perspective view of a second preferred embodiment of the novel terminal apparatus of this invention.

Referring now to FIG. 5, a second preferred embodiment of the novel terminal apparatus of this invention is shown generally at 50 and includes a flat disc 52 with center hole 51 and a plurality of detents 54 formed around the external periphery of flat disc 52. Detents 54 are formed by the periphery of flat disc 52 being deformed by a stamp press (not shown) to create detents 54. Detents 54 are configured to cooperate in nesting relationship with corresponding detents in the next succeeding terminal 50 stacked thereupon. A connector 62 extends from one edge of flat disc 52 and includes a pair of flanges 63a and 63b which are crimped to provide a secure mechanical and electrical connection with conductive wires 64 of electrical conduit 66. An insulative sheath 65 is removed from a portion of conductive wires 64 to allow flanges 63a and 63b to be clamped to conductive wires 64.

Figure 6:
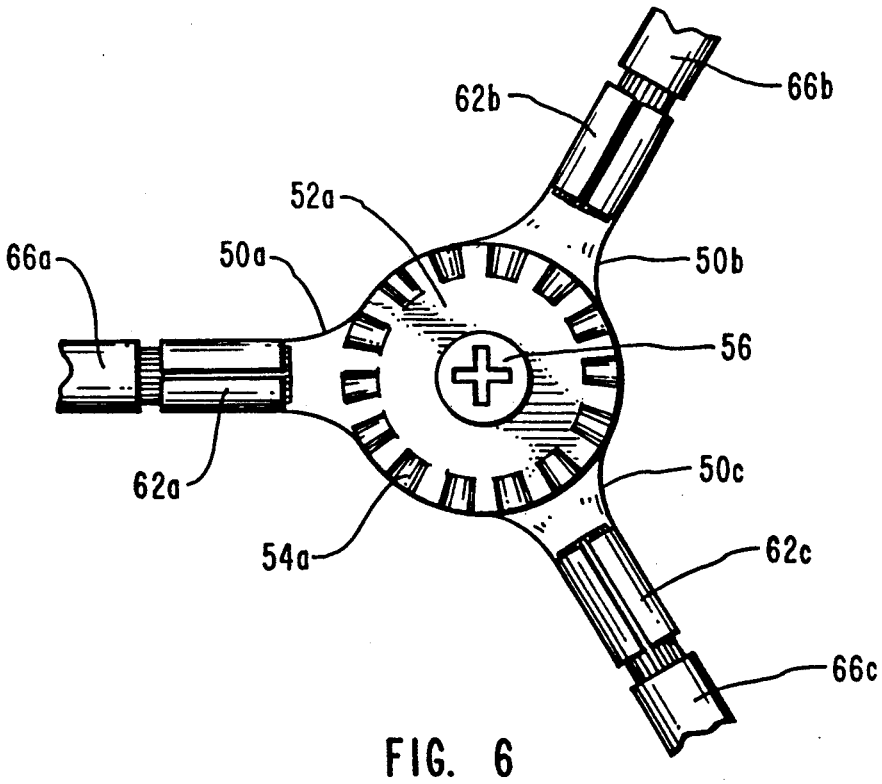
FIG. 6 is a plan view of three of the second preferred embodiment of the novel terminal apparatus shown in FIG. 5 each of the terminals being oriented at an angular offset from the other.

Detents 54 are formed at a plurality of points spaced equidistantly around the periphery of flat disc 52. Uniform spatial placement of detents 54 accommodates the nesting relationship between a plurality of terminals such as shown in FIG. 6 wherein a plurality of terminals 50, terminals 50a–50c, are electrically coupled to electrical conduits 66a–66c, respectively, and stacked one on top of the other with detents 54a in nesting relationship to the adjacent detents (not shown) in terminal 50b. Correspondingly, the detents (not shown) in terminal 50b nest with the detents (not shown) in terminal 50c. The orientation of terminals 50a–50c relative to each other is limited only by the orientation of detents 54. For example, if there are eighteen detents 54 equidistantly formed around the periphery of flat disc 52 the result is a detent 54 at each twenty degrees around the periphery. This would mean that terminal 50b could be mounted at any one of eighteen orientations relative to terminal 50a so long as connectors 62a and 62b do not physically interfere with each other. A bolt 56 securely holds the stacked terminals 50a–50c together.

Figure 7:
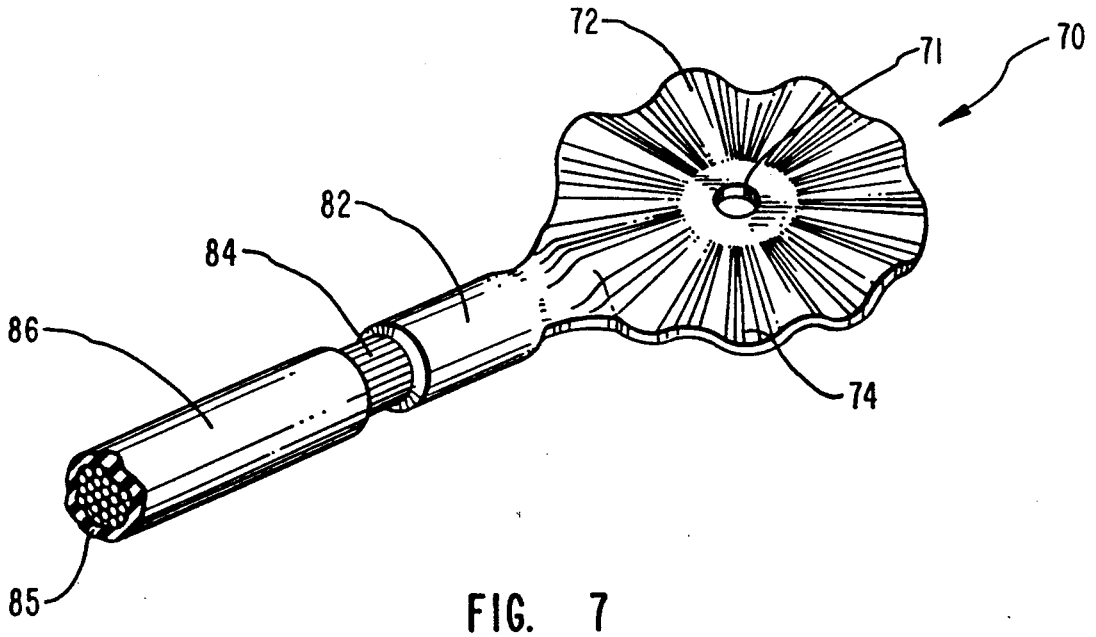
FIG. 7 is a perspective view of a third preferred embodiment of the novel terminal apparatus of this invention.

Referring now to FIG. 7, a third preferred embodiment of the terminal of this invention is shown generally at 70 and includes a diametrally enlarged terminal member 72 having a hole 71 at its center. Terminal member 72 is connected at connector 82 to conductive wires 84 of an electrical conduit 86. An insulative sheath 85 has been removed from conductive wires 84 so as to allow connector 82 to be securely connected thereto both mechanically and electrically. Terminal member 72 is configured with a plurality uniformly spaced convolutions 74 around the periphery of terminal member 72. Convolutions 74 are formed with an increasing height on each side of terminal member 72 as they extend radially outwardly from hole 71.

Figure 8:
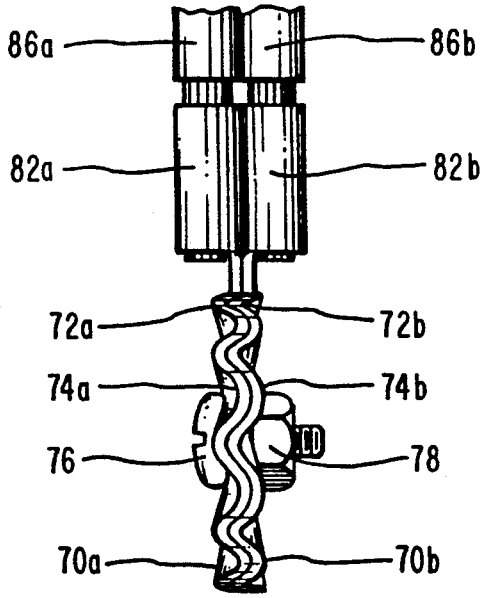
FIG. 8 is a side view of two of the terminals of FIG. 7 joined together in a back-to-back relationship.

Referring now to FIG. 8, convolutions 74a formed in a terminal member 72a of a terminal 70a are designed to nest with adjacent convolutions 74b formed in a terminal member 72b of a terminal 70b so as to provide a secure interlock between terminals 70a and 70b. Advantageously, terminals 70a and 70b can be oriented back to back with their respective connectors 82a and 82b oriented parallel to each other. Connectors 82a and 82b electrically couple terminals 70a and 70b to electrical conduits 86a and 86b, respectively. A bolt 76 and a nut 78 securely anchor terminals 70a and 70b together. Convolutions 74a and 74b are designed to nest together regardless of which face of terminal 70b is presented to terminal 70a. Further, additional terminals 70 (FIG. 7) can be stacked against either of terminals 70a or 70b and at any of the angles available as determined by the angular offset of the sinusoidal convolutions 74 (FIG. 7).

The Method

The novel terminals 30, 50, and 70 of this invention are configured so as to effectively prevent rotational movement relative to the axis of the holes 31, 51, and 71 therein, respectively, thereby reducing the likelihood of the terminals becoming loosened over time. Importantly, the various detent means employed in terminals 30, 50, 70 are each designed to cooperate in nesting relationship so that a plurality of matching terminals 30, 50, and 70 can be stacked together with their respective detents cooperating in nesting relationship.

The nesting relationship provided by the various types of detents of this invention effectively preclude rotational movement of the respective electrical conductors in a direction about the axis of the aligned holes. Further, the marginally increased surface created upon deformation of the metal disc creates a corresponding increase in the surface area of the metal disc available for metal-to-metal contact for improved electrical conductivity. The nesting relationship between the terminals also creates a slight frictional engagement between the surfaces of the nesting detents thereby further enhancing the formation of a suitable surface area for improved electrical conductivity between terminals.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A terminal system for electrically and mechanically connecting a first electrical conductor to a second electrical conductor in a non rotational relationship comprising:

a first terminus for said first electrical conductor comprising:

a diametrally enlarged first metal disc having a face and a back, said first metal disc comprising a first engagement means for mechanically engaging said first terminus to a second terminus in a non rotational engagement while electrically coupling said first terminus to said second terminus, said first metal disc being fabricated from a sheet metal and having a generally circular profile;

first connector means extending from a periphery of said first metal disc, said first connector means electrically connecting said first terminus to said first electrical conductor; and first detent means in said first metal disc, said first detent means comprising first detents formed as uniformly spaced deformations of said first metal disc around the periphery of said first metal disc to create said first detent means on said face and said back of said first metal disc;

said second terminus comprising;

a diametrally enlarged second metal disc having a face and a back, said second metal disc comprising a second engagement means for mechanically engaging said second terminus to said first terminus in said non-rotational engagement while electrically coupling said second terminus to said first terminus, said second metal disc being fabricated from said sheet metal and having a generally circular profile;

second connector means extending from a periphery of said second metal disc, said second connector means electrically connecting said second terminus to said second electrical conductor; and second detent means in said second metal disc, said second detent means comprising second detents formed as uniformly spaced deformations of said second metal disc around the periphery of said second metal disc to create said second detent means on said face and said back of said second metal disc, said second detent means cooperating in nesting relationship, said first detent means in a face to back relationship, said first detent means and said second detent means thereby mechanically resisting angular rotation of said first terminus relative to said second terminus; and nesting means for nesting said first detent means with said second detent means comprising a fastener means for fastening said first terminus to said second terminus to form said terminal system with said first metal disc stacked against said second metal disc in a back-to-back relationship with said first detent means in nesting relationship with said second detent means, said terminal system being characterized by the absence of a washer between said first terminus and said second terminus.

2. The terminal system defined in claim 1 wherein said first and second detent means comprise a plurality of circular indentations in said first and second metal disc, said indentations being uniformly spaced in a circle around a center of said first and second metal disc.

3. The terminal system defined in claim 1 wherein said first and second detent means comprise a plurality of indentations formed equidistantly around the periphery of said first and second metal disc.

4. The terminal system defined in claim 1 wherein said first and second detent means comprise a plurality of uniform sinusoidal convolutions in the periphery of said first and second metal disc.

5. The terminal system defined in claim 1 wherein said nesting means comprises a fastener means comprising a hole through the center of said first and second metal discs and a bolt for passing through said hole, said bolt fastening said first and second metal discs together with said first and second detent means cooperating in nesting relationship.

6. The terminal defined in claim 1 wherein said diametrally enlarged coupling means comprises a metal disc fabricated from a sheet metal and having a generally circular profile.

7. The terminal defined in claim 6 wherein said detent means are formed in said metal disc by selectively deforming selected portions of said metal disc to create said detents, said detents in said terminal cooperating in nesting relationship with said detents in said second terminal.

8. A terminal system for interlocking electrical conductors in a mechanically non rotational engagement comprising:

a first connector for electrically mounting a first terminal to a first electrical conductor;

a first metal disc extending from said first connector, said first metal disc having a face and a back and an enlarged diameter and a hole in the center;

first detent means formed in said first metal disc as uniformly spaced deformations around the periphery of said first metal disc, said deformations being formed into said face and back of said first metal disc;

a second connector for electrically mounting a second terminal to a second electrical conductor;

a second metal disc extending from said second connector, said second metal disc having a face and a back and an enlarged diameter and a hole in the center;

a second detent means formed in said second metal disc as uniformly spaced deformations around the periphery of said second metal disc, said deformations being formed into said face and back of said second metal disc, said second detent means and said first detent means being configured to cooperate in nesting relationship when said first and second terminals are stacked face to back with the holes therein in alignment, said nesting relationship of said first and second detent means thereby interlocking said electrical conductors; and fastener means for fastening a plurality of said first and second terminals together in said nesting relationship.

9. The terminal system defined in claim 8 wherein fastener means comprises a hole in the center of said first and second metal disc and a bolt operable to pass through said hole, said bolt cooperating with a nut to securely fasten a plurality of said first and second terminals together with said first and second detent means in each of said first and second terminals cooperating in nesting relationship thereby securely engaging plurality of said first and second terminals together in a nonrotational configuration.

10. The terminal system defined in claim 8 wherein said first and second detent means comprises a plurality of uniformly spaced deformations in said first and second metal disc.

11. The terminal system defined in claim 10 wherein said spaced deformations comprise a plurality of indentations formed in each of said first and second metal disc, said indentations being formed in a circle around the center of said first and second metal disc, said circle being formed at a point between said center and a perimeter of said first and second metal disc, said indentations being spaced equidistantly around said circle.

12. The terminal system defined in claim 10 wherein said spaced deformations comprise a plurality of detents formed equidistantly around the periphery of said first and second metal disc.

13. The terminal system defined in claim 10 wherein said spaced deformations comprise a plurality of uniformly formed sinusoidal convolutions in the periphery of said first and second metal disc.

14. A method for preventing relative rotational movement among terminals from a plurality of electrical conductors comprising:

obtaining a diametrally enlarged metal disc with a central hole and a connector extending from an edge of said metal disc, said metal disc having a face and a back;

creating a plurality of uniformly spaced detent means in said metal disc, said detent means comprising deformations of said metal disc, said deformations extending into said face and said back;

fabricating a terminus for each electrical conductor by attaching said connector to said electrical conductor, said metal disc thereby forming said terminus for said electrical conductor;

interlocking a plurality of said termini together with said central holes in alignment and with said detent means in nesting relationship with said deformations in said face interlocking with said deformations in said back; and preventing relative rotational movement by securing said plurality of termini together by passing a bolt means through said central holes of said metal discs.

15. The method defined in claim 14 wherein said creating step comprises forming said detent means as a plurality of uniformly spaced indentations in a circle around said central hole, said circle being formed between said central hole and the periphery of said metal disc.

16. The method defined in claim 14 wherein said creating step comprises forming said detent means as a plurality of uniformly spaced indentations in the periphery of said metal disc.

17. The method defined in claim 14 wherein said creating step comprises forming said detent means as a plurality of uniformly spaced sinusoidal convolutions in the periphery of said metal disc.

* * * * *